United States Patent [19]

Lund, Jr. et al.

[11] 4,287,495

[45] Sep. 1, 1981

[54] THERMALLY COMPENSATED PHASE-STABLE WAVEGUIDE

[75] Inventors: Walter W. Lund, Jr., Seattle; Ervin J. Nalos, Bellevue; Donald E. Skoumal, Auburn, all of Wash.

[73] Assignee: The Boeing Company, Seattle, Wash.

[21] Appl. No.: 135,873

[22] Filed: Mar. 31, 1980

[51] Int. Cl.[3] ..... H01P 1/30; H01P 3/12

[52] U.S. Cl. ..... 333/239; 333/229

[58] Field of Search ..... 333/229, 239, 242, 248; 29/600; 428/113

[56] References Cited

U.S. PATENT DOCUMENTS 3,982,215 9/1976 Lo et al. ..... 333/248 X

*Primary Examiner*—Paul L. Gensler

*Attorney, Agent, or Firm*—Cole, Jensen & Puntigam

[57] ABSTRACT

The waveguide is constructed with a specially designed laminate which comprises multiple plies of a graphite-epoxy composite. Thermal compensation is achieved by orienting the graphite fibers in the various plies in selected directions. Graphite fiber has a negative coefficient of thermal expansion while epoxy has a positive coefficient of thermal expansion. At least one ply in the laminate has longitudinally oriented graphite fibers while a second ply has transversely oriented fibers. Third and fourth plies, intermediate of the first and second plies, have graphite fibers which are oriented at selected angles relative to the longitudinal and transverse plies. The angles of orientation of the graphite fibers in the intermediate plies are selected by use of an equation and a set of curves relating the temperature characteristics of the laminate to fiber angle, once the width of the waveguide and the free-space wavelength of the signal propagated in the waveguide are known.

9 Claims, 4 Drawing Figures

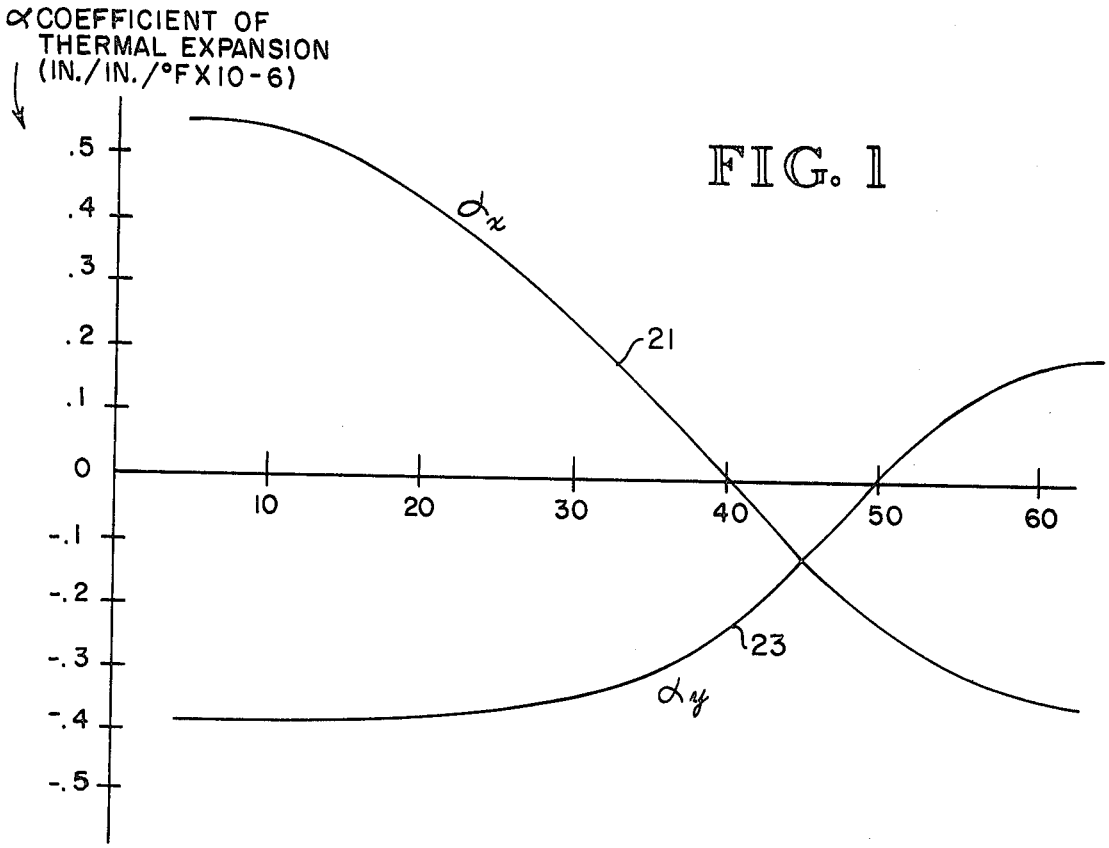
FIG. 1
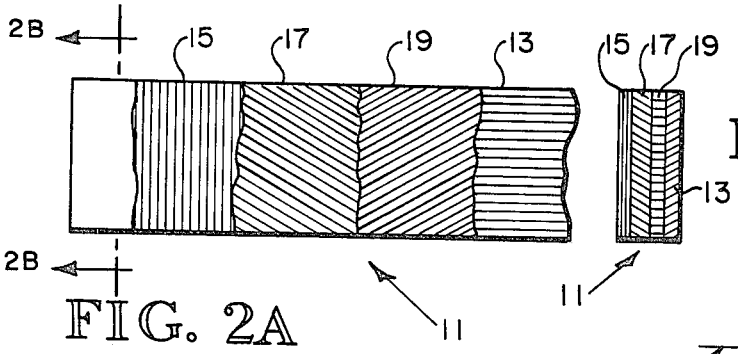
FIG. 2B
FIG. 2A
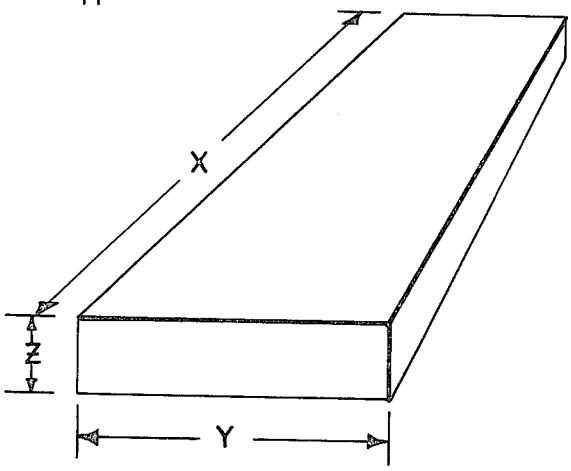
FIG. 3

THERMALLY COMPENSATED PHASE-STABLE WAVEGUIDE

BACKGROUND OF THE INVENTION

This invention relates generally to the waveguide art, and more specifically concerns a waveguide constructed from a laminate comprising several fibrous plies, wherein the fibers of the various plies are oriented in particular directions, selected so that the resulting waveguide is thermally compensated for a particular application.

In many waveguide applications, such as, for instance, in use with an antenna which comprises a plurality of radiating elements, a high degree of inter-element signal phase stability is required, i.e. the signals from the feeding waveguide present at all of the radiating elements must be in phase with each other. Many waveguides, while otherwise suitable for such applications, often cannot be used in a particular application because of such a phase instability characteristic.

The primary source of phase instability in waveguides is temperature sensitivity of the material comprising the waveguide. As the temperature of the environment changes, the length of the waveguide changes sufficiently relative to the length of the waveguide signal that the waveguide now accommodates additional cycles or a substantial portion of an additional cycle of the waveguide signal, which in turn results in a change of phase in the signal at the exit of the waveguide, and hence a change of phase in the signals applied to the radiating elements. Element to element phasing is thus seriously degraded.

Most waveguides have heretofore been constructed of metal, because of its good electrical properties. However, metals have a high coefficient of thermal expansion, and therefore are sensitive to changes in temperature, with resulting dimensional changes and phase instability for the waveguide.

Both active and passive compensation techniques have been used to increase the phase stability of such metal waveguides. In a representative active technique, circuitry is used to cause a time delay in the waveguide signal. The length of the delay is adjustable and can be changed to precisely compensate for the particular temperature change. However, such a system is not inherently corrective, i.e. it does not automatically change its correction as the temperature changes; it must instead be adjusted to each particular temperature. Such circuitry is also typically expensive to implement and requires installation.

Passive techniques generally involve the use of special materials which are not as temperature dependent as conventional metals. As an example, the metal Invar, which has a relatively low coefficient of thermal expansion, has been used. However, Invar is quite expensive, and also quite heavy, having a density of approximately that of steel. These characteristics make the widespread use of Invar in spacecraft waveguide applications impractical.

Another material which has been used for waveguides is graphite epoxy, which is a composite of graphite fibers and epoxy. The graphite has a negative coefficient of thermal expansion while the epoxy has a positive coefficient of thermal expansion. The use of a graphite epoxy composite has resulted in a decrease in temperature dependence of the waveguide by virtue of an improvement in the coefficient of thermal expansion by a factor of approximately two orders of magnitude. However, even such an improved performance resulting from the use of the graphite epoxy composite has proven to be insufficient for many applications in which an even higher degree of phase stability is required.

Accordingly, it is a general object of the present invention to provide a waveguide which overcomes one or more of the disadvantages of the prior art stated above.

It is a further object of the present invention to provide such a waveguide which is thermally compensated to the extent that it is relatively phase stable.

It is another object of the present invention to provide such a waveguide which is passively compensated for thermal expansion.

It is an additional object of the present invention to provide such a waveguide which is compatible with active circuitry designed for additional thermal compensation.

It is yet another object of the present invention to provide such a waveguide which is relatively lightweight and is competitive economically with other waveguide configurations.

SUMMARY OF THE INVENTION

The present invention includes both a method for making a temperature compensated waveguide, and the resulting waveguide, where the waveguide is made from a laminate comprising a plurality of plies of a fibrous composite material, including a set of plies which have their fibrous content oriented at an angle $\theta$ relative to the longitudinal dimension of the waveguide. In a first step, using an equation, and knowing the width of the waveguide and the free-space wavelength of the signal propagated in the waveguide, the ratio of the coefficient of thermal expansion of the material comprising the waveguide in the longitudinal direction and the coefficient of thermal expansion in the transverse direction necessary to result in a compensating change in width for a change in waveguide length due to temperature change is ascertained. The ratio information is then used to determine, from curves showing both transverse and longitudinal coefficients of expansion versus fiber angle $\theta$, the particular fiber angle corresponding to the determined ratio. The waveguide is constructed with a laminate element which is formed into the shape of a waveguide, said laminate element comprising a plurality of successive plies of a fibrous composite material, one ply having its fibrous content aligned generally parallel to the longitudinal dimension of the waveguide, a second ply having its fibrous content aligned generally parallel to the transverse dimension of the waveguide, and third and fourth plies having their fibrous content oriented at the selected angle $\theta$ relative to the longitudinal dimension of the waveguide, such that the width of the waveguide changes in response to a given change in temperature sufficiently to just compensate, in terms of the phase characteristics of the waveguide, for the change in length of the waveguide due to the given change in temperature.

DESCRIPTION OF THE DRAWINGS

A more thorough understanding of the invention may be obtained by a study of the following detailed description, taken in connection with the accompanying drawings in which:

FIG. 1 is a diagram showing the change in the coefficient of thermal expansion relative to angular fiber orientation in both longitudinal and transverse directions for the graphite-epoxy laminate waveguide of the present invention.

FIG. 2*a* is a plan, partially cutaway, view showing the orientation of the fibers in each ply of one embodiment of the laminate of the present invention.

FIG. 2*b* is a cross-section of the laminate section of FIG. 2*a*, along lines 2*b*—2*b*.

FIG. 3 is a perspective view of a portion of a waveguide.

DESCRIPTION OF PREFERRED EMBODIMENT

Objects such as waveguides, constructed from known materials, will change dimensionally both longitudinally and transversely, in a known fashion according to the coefficient of thermal expansion of the material. Those objects which are constructed from materials having relatively large coefficients of thermal expansion, such as most metals, will undergo rather large dimensional changes for a given change in temperature.

In the case of an object such as a waveguide, even a relatively small change, however, in the dimensions of the waveguide will have a very significant impact on its operation, i.e. the phase of the waveguide signal will change significantly because the wavelength of waveguide signal is typically very small, usually in the microwave range.

As indicated above, the expansion characteristics of the object depend on the expansion characteristics of the material comprising the object. Thus, if the expansion characteristic of a material is substantially the same in all directions, then the object itself will also change substantially equally in all directions. Equally, if the expansion characteristic of a material is different along different dimensions, the object itself will change dimensionally accordingly. In addition, the relative expansion characteristics of an object, along its various dimensions, can be controlled to an extent by using composite materials, which comprise a combination of materials having differing coefficients of thermal expansion.

Graphite-epoxy is a known composite which has a low coefficient of thermal expansion in one dimension. Graphite fiber has a negative coefficient of thermal expansion while epoxy has a positive coefficient of thermal expansion. The composite exhibits thermal expansion characteristics which are a significant improvement over materials previously used in the construction of waveguides. However, even the graphite-epoxy composite exhibits some thermal expansion which is detrimental to the operation of a waveguide. The characteristics of thermal expansion and it's impact on the operation of a particular waveguide will, however, vary from application to application, particularly as the configuration of the waveguide changes. Because the graphite-epoxy composite has different characteristics of thermal expansion in the longitudinal and transverse dimensions, the effect of a thermal change on the operation of the waveguide will depend not only on the amount of temperature change, but also on the configuration of the waveguide.

Referring now to FIGS. 2A and 2B, the present invention is a waveguide constructed from a fibrous ply laminate material, in which the fiber content of the individual plies comprising the laminate are arranged in a selected orientation. It has been discovered by applicants that the use of a laminate having certain sequences of fiber-containing plies in which the fibrous content is oriented in selected directions results in a waveguide structure which changes dimensionally in width in the exact amount necessary to compensate electrically for the small change in the length of the waveguide due to the expansion characteristics of the material. A precise temperature compensation is thus achieved.

In the embodiment shown, the laminate comprises four layers, shown generally at 11 in FIGS. 2*a* and 2*b*. The material comprising each ply is a graphite-epoxy composite having the known low thermal expansion characteristics of that material. However, it is not necessary that the material comprising the laminate plies be graphite-epoxy. In more general terms, a composite comprising fibrous material in a matrix binder is necessary. Graphite-epoxy is one known composite in that category. Further, it is not necessary that the fiber content have a negative coefficient of thermal expansion, while the binder material has a positive coefficient of thermal expansion. In certain applications, such an arrangement may be preferable, but composites in which both the fiber and the binder have positive or negative coefficients are still satisfactory.

In the embodiment shown, one of the exterior plies, i.e. the lowermost ply 13 in FIG. 2, has its fiber content arranged to run longitudinally of the laminate, while the uppermost ply 15 has its fiber content oriented transversely. It is not necessary, however, that the longitudinal and transverse plies be the exterior plies.

The intermediate plies 17 and 19 have their fiber content arranged at a selected angle $\theta$ relative to the longitudinal axis of the laminate sheet. In one ply the angle $\theta$ is positive, while in the other, the angle $\theta$ is negative, i.e. the angle of the fiber content in one ply, relative to the longitudinal axis, is measured in a clockwise direction, while the fiber angle in the other ply is measured counterclockwise. The fiber angles of the two plies are referred to as plus and minus $\theta$. In the embodiment shown, for instance, ply 17 is oriented at an angle of 26° clockwise relative to the longitudinal axis reference line, while ply 19 is oriented at an angle of 26° counterclockwise relative to the longitudinal axis.

The two plies 17 and 19 operate as a set and they should have equal and opposite $\theta$ angles, approximately the same thickness and should be positioned symmetrical relative to the longitudinal center plane of the laminate, i.e. a plane midway between the uppermost and lowermost laminates.

Other pairs of plies, with different $\pm\theta$ angles, may also be included in the laminate, although all the ply pairs should be symmetrical with respect to the centerplane. As long as symmetry is maintained, a particular stacking sequence is not critical to the thermal compensation qualities of the laminate, although the stacking sequence will affect other characteristics of the laminate, such as strength.

By using a laminate, the thermal expansion characteristics of a particular object can be controlled independently in both the transverse and longitudinal directions. The key advantage to this approach is that the configuration of a waveguide, which is a variable, can be precisely accommodated, which is not otherwise possible with a single sheet of material, composite or otherwise, which has fixed expansion characteristics in both the longitudinal and transverse directions.

Hence, a laminate can be constructed for use in a particular waveguide which has a particular sequence of plies which in turn have their fibrous content oriented in selected directions so that the thermal expansion of the laminate in the transverse direction of the waveguide compensates for the thermal expansion of the laminate, however small, in the longitudinal direction caused by temperature change. Such a compensation technique is passive and essentially electrical in nature, matched to the particular waveguide configuration, as explained in more detail hereinafter.

As an example, a graph of the coefficient of thermal expansion characteristics for a particular eight ply graphite-epoxy laminate with a ply configuration of 0°, $+\theta$, $-\theta$, 90°, 90°, $-\theta$, $+\theta$, 0°, where 0° is the longitudinal reference, is shown in FIG. 1. Line 21 is a plot of the coefficient of thermal expansion versus angle $\theta$ in the longitudinal direction ($\alpha_x$), while line 23 is a plot of the coefficient of thermal expansion versus angle $\theta$ in the transverse direction ($\alpha_y$).

For a particular waveguide, it is first necessary to determine the ratio of $\alpha_x$ to $\alpha_y$ necessary to achieve compensation. This is done by using the formula developed in following paragraphs, after the width of the waveguide and the free-space wavelength of the signal propagation in the waveguide are known. After these values are ascertained, then the coefficient of expansion curves for the composite material (such as FIG. 1) can be consulted to ascertain the correct fiber angle $\theta$.

If, in a particular situation, for example, it is necessary to have the coefficient of thermal expansion $\alpha_x$ in the longitudinal dimension equal and opposite to the coefficient of thermal expansion $\alpha_y$ in the transverse direction, the absolute value of angle $\theta$ of the fiber content in the plies, from FIG. 1, would be approximately 26°. It is also possible, of course, as seen in FIG. 1, to meet different requirements with different values of $\theta$, i.e. in the range of $\theta$=zero degrees to $\theta$=45°, in which the ratio of $\alpha_x$ (longitudinal) to $\alpha_y$ (transverse), referred to as $K_o$, is anywhere between zero and $-1$. With other types of composites, ply arrangements, and/or fiber content, even a greater range of values of $K_o$ may be obtained.

Referring now to FIG. 3, phase stability, for a rectangular waveguide of typical application, means that the longitudinal dimension X of the waveguide remain a fixed multiple of the wavelength $\lambda_g$ of the electrical signal in the waveguide, i.e. so that:

$$X = n\,\lambda_g \tag{1}$$

where n is an integer. As the temperature of the waveguide increases, the longitudinal dimension of the waveguide will increase from X to X', i.e. $X' = X + \Delta X$. Since $\Delta X$ is equal to the coefficient of expansion $\alpha_x$ in the longitudinal direction multiplied by the unequal longitudinal dimension X of the wave guide and the increase in temperature $\Delta T$, then $X' = X\,(1 + \alpha_x \Delta T)$. Thus:

$$\Delta X = X \alpha_x\, \Delta T \tag{2}$$

Since the design goal is for a phase stable waveguide, then X' must equal $n\lambda g$. Thus, $\Delta X = n\Delta\lambda g$. By differentiating equation 1, and combining the result with equation 2, $$X = \frac{n\Delta\lambda_g}{\alpha_x \Delta T} \tag{3}$$

The wavelengths of the source signal in the waveguide $\lambda_g$ and in free space $\lambda$ and the waveguide cutoff wavelength $\lambda_c$ of the waveguide are related by the known equation, $$\lambda_g = \frac{\lambda}{[1 - (\lambda/\lambda_c)^2]^{\frac{1}{2}}} \tag{4}$$

In order to obtain the sensitivity of the waveguide to changes in the width of the waveguide, equation 4 is differentiated with respect to $\lambda_c$:

$$\frac{d\lambda_g}{d\lambda_c} = -\frac{[\lambda/\lambda_c]^3}{[1 - (\lambda/\lambda_c)^2]^{3/2}} \tag{5}$$

The analysis of thermal expansion in the transverse dimension Y of the waveguide of FIG. 3 is similar to the above analysis for the effect of thermal expansion in the longitudinal direction. Thus, $$Y' = Y + \Delta Y = Y\,(1 + \alpha_y \Delta T) \tag{6}$$

It is known that $\lambda_c = 2Y$ for the fundamental $TE_{10}$ waveguide mode. Then, $$\Delta\lambda_c = 2\Delta Y = 2Y\alpha_y \Delta T \tag{7}$$

By combining equations 3, 5 and 7, the expression $\Delta T$ can be eliminated, which results in an expression which contains only the coefficients of temperature expansion in the transverse and longitudinal directions.

$$K_o = -\frac{\alpha_x}{\alpha_y} = \frac{(\lambda/\lambda_c)^2}{[1 - (\lambda/\lambda_c)^2]} \tag{8}$$

substituting
$\lambda_c = 2Y$, $$K_o = -\frac{\alpha_x}{\alpha_y} = \frac{[\lambda/2Y]^2}{1 - (\lambda/2Y)^2}$$

The above equation sets out the necessary ratio between $\alpha_x$ and $\alpha_y$ to achieve compensation in terms of the width of the waveguide and the free space wavelength of the signal propagated in the waveguide. For an S band waveguide, for instance, where Y equals 9.094 cm. and $\lambda$ equals 12.245 cm.:

$$K_o = -\frac{\alpha_x}{\alpha_y} = -0.829$$

From this information, the proper orientation of the fibers in the various plies may be selected in order to provide the desired temperature compensation for the device.

When a graphite-epoxy composite material is utilized, the waveguide must be plated on the inside with an electrically conductive material, such as copper or silver, in order to provide the required electrical properties for the waveguide. The plating need only be several microwave skin depths deep, which in most cases is on the order of a few microns at most microwave frequencies. This conductive layer does not significantly affect the thermal expansion properties of the composite waveguide, however, since the composite is much thicker than the conductive layer. Such a plating would not be necessary, however, for a composite which itself was electrically conducting, such as a metal matrix composite-like graphite aluminum.

Thus, a thermally compensated waveguide has been disclosed which, in one embodiment, uses a graphite-epoxy composite which, although having a relatively low coefficient of thermal expansion, is still not acceptable in certain waveguide applications. In the invention, a waveguide is made from a laminate comprising a pluraity of plies of a fibrous composite material, e.g. graphite-epoxy. By orienting the fibers of the laminate plies in accordance with the principles outlined above, the shift in phase of the waveguide signal, due to the longitudinal growth of the waveguide because of temperature change, is compensated for electrically by a change in the width of the waveguide sufficient that there is no net change in the phase of the signal exiting from the waveguide. Hence, the present invention results in a passive thermal compensation which is capable of being uniquely designed for each waveguide application.

Although a preferred embodiment of the invention has been disclosed herein for purposes of illustration, it should be understood that various changes, modifications and substitutions may be incorporated in such embodiment without departing from the spirit of the invention as described by the claims which follow.

What is claimed is:

1. A phase-stable, temperature-compensated waveguide comprising:

laminate element means formed into a waveguide configuration, said laminate element means comprising a plurality of successive plies of fibrous composite material, one ply having its fiber content aligned generally parallel to the longitudinal dimension of the waveguide, a second ply having its fiber content aligned generally parallel to the transverse dimension of the waveguide, and a first set of third and fourth plies having their fiber content oriented at selected angles relative to the longitudinal dimension of the waveguide, such that the transverse dimension of the waveguide changes sufficiently relative to a change in the longitudinal dimension of the waveguide due to temperature change that the phase of the signal exiting from the waveguide does not change in response to temperature.

2. An apparatus of claim 1, wherein the fiber content of one of the third and fourth plies is oriented at the selected angle measured clockwise relative to the longitudinal dimension of the waveguide, while the fiber content of the other of the third and fourth plies is oriented at the same selected angle measured counterclockwise relative to the longitudinal dimension of the waveguide.

3. An apparatus of claim 2, wherein said third and fourth plies are positioned such that they are substantially symmetrical relative to a center plane of the laminate element means.

4. An apparatus of claim 2, wherein said third and fourth plies are substantially the same thickness and are comprised of the same composite material.

5. An apparatus of claim 1, including more than one set of angled fiber plies, wherein one of each set of angled fiber plies has fibers oriented at a selected angle measured clockwise relative to the longitudinal dimension of the waveguide while the other ply in each set has fibers oriented at the selected angle measured counterclockwise from the longitudinal dimension of the waveguide, wherein said sets of plies are oriented symmetrically with respect to the center plane of the laminate element means.

6. An apparatus of claim 1, wherein said first and second plies form opposite surfaces of said laminate element means.

7. An apparatus of claim 1, including more than one ply oriented parallel to the longitudinal dimension of the waveguide and more than one ply oriented parallel to the transverse dimension of the waveguide, and wherein the entire laminate element means is symmetrical about a center plane thereof.

8. An apparatus of claim 1, wherein said fibrous composite material includes at least one element having a negative coefficient of thermal expansion and at least one element having a positive coefficient of thermal expansion.

9. An apparatus of claim 8, wherein said fibrous composite material comprises graphite fibers in an epoxy binder.

* * * * *